US006263541B1

(12) United States Patent
Scates

(10) Patent No.: US 6,263,541 B1
(45) Date of Patent: Jul. 24, 2001

(54) WINDING CONE OF AN OVERHEAD DOOR COUNTERBALANCING MECHANISM AND TORSION SPRING WINDING METHOD THEREFOR

(75) Inventor: John E. Scates, Carrollton, TX (US)

(73) Assignee: Windsor Door, Inc., Little Rock, AR (US)

( * ) Notice: Subject to any disclaimer, the term of this patent is extended or adjusted under 35 U.S.C. 154(b) by 0 days.

(21) Appl. No.: 09/234,616

(22) Filed: Jan. 21, 1999

(51) Int. Cl.[7] ..... E05F 1/16; E05D 13/00
(52) U.S. Cl. ..... 16/198; 16/197; 160/191
(58) Field of Search ..... 16/198, 197, 193, 16/DIG. 1; 160/191; 49/322, 200

(56) References Cited

U.S. PATENT DOCUMENTS

| | | | | |
|---|---|---|---|---|
| 3,615,065 | * | 10/1971 | Elliott | 16/198 |
| 3,685,567 | * | 8/1972 | Pemberton et al. | 160/191 |
| 3,779,537 | * | 12/1973 | Kalister | 267/166.1 |
| 3,979,977 | * | 9/1976 | Dorma | 81/57.13 |
| 4,073,038 | | 2/1978 | Currey et al. . | |
| 4,817,242 | | 4/1989 | Rapp . | |
| 4,817,927 | | 4/1989 | Martin . | |
| 4,882,806 | | 11/1989 | Davis . | |
| 4,930,182 | * | 6/1990 | Eichenberger | 16/198 |
| 4,981,165 | * | 1/1991 | Miller et al. | 160/191 |
| 5,048,155 | | 9/1991 | Hwang . | |
| 5,239,777 | | 8/1993 | Husselton . | |
| 5,419,010 | * | 5/1995 | Mullet | 16/198 |
| 5,605,079 | | 2/1997 | Way . | |
| 5,632,063 | | 5/1997 | Carper et al. . | |
| 5,636,678 | | 6/1997 | Carper et al. . | |
| 5,638,640 | | 6/1997 | Harbeck et al. . | |
| 5,671,500 | | 9/1997 | Balk . | |

* cited by examiner

*Primary Examiner*—Chuck Y. Mah
(74) *Attorney, Agent, or Firm*—Kennedy Covington Lobdell & Hickman, LLP

(57) ABSTRACT

A method of securing a torsion spring used in a counterbalance system in which the spring torsion cannot be released without first supporting any existing spring torque utilizes a torsion spring assembly including: a torsion rod extending along a longitudinal axis of and within a torsion spring; an anchor member retaining a first end of the torsion spring with the torsion rod being rotatable about the axis relative to the anchor member; and a winding cone retaining a second end of the torsion spring. The winding cone includes a first winding cone coupling member including a frusto-conical surface retaining the second end of the torsion spring; and a second winding cone coupling member and a fastener. The second coupling member defines an area in which the fastener is received for releasably mounting the second coupling member to the torsion rod. The first coupling member is disposed adjacent and abuts the second coupling member for limited rotational movement between first and second rotational positions. The second coupling member includes a blocking portion which engages the first coupling member and prevents rotation of the first coupling member relative to the second coupling member in a first rotational direction when the first coupling member is in the first rotational position. The first coupling member includes a covering portion inhibiting access to the fastener in the first rotational position but permitting access in the second rotational position. The torsion spring urges the first coupling member in the first rotational direction.

30 Claims, 9 Drawing Sheets

WINDING CONE OF AN OVERHEAD DOOR COUNTERBALANCING MECHANISM AND TORSION SPRING WINDING METHOD THEREFOR

FIELD OF THE PRESENT INVENTION

The present invention relates to a winding cone for a torsion spring and, in particular, to a winding cone used in a torsion spring assembly of an overhead door counterbalancing mechanism.

BACKGROUND OF THE PRESENT INVENTION

A conventional winding cone includes both a frustoconical surface for receiving and retaining an end of a torsion spring and a base having an opening therein for receiving a set screw whereby the end of the spring is fixed to a torsion rod extending axially through the winding cone. With this type of winding cone, the force of the spring does not have to be overcome prior to releasing the set screw. The set screw can simply be released without regard to the torque of the torsion spring on the winding cone. Consequently, an inexperienced person often will release the set screw without sufficiently bracing against the torque of the torsion spring thereby leading to unexpected and rapid unwinding of the torsion spring and possible injury. A need therefore exists for a failsafe whereby the torque of the torsion spring must first be overcome before the securement of the torsion spring to the torsion rod by the set screw can be released.

Balk U.S. Pat. No. 5,671,500 is illustrative of a conventional torsion spring assembly used in a counterbalancing mechanism for an overhead door. The torsion spring 3 is axially disposed about torsion rod 20. One end of the spring is retained by cone 16 that is mounted to the rod 20 by adjustable mounting 18, and the other end of the spring is retained by cone and bracket 12 which are rotationally fixed relative to rod 20. Rotation of rod 20 causes rotation of mounting 18, cone 16, and torsion spring 3 leading to a change in the tension of the torsion spring 3. The tension range is adjusted by: first releasing a set screw which fixes mounting 18 to rod 20; next rotating mounting 18, cone 16, and spring 3 relative to the rod 20 in the desired direction; and then re-engaging the set screw with the rod 20 through the mounting 18. No failsafe is provided to insure that the tension in torsion spring 3 will be maintained when the set screw is released from torsion rod 20.

With more particular detail to the conventional structure of a winding cone itself, Martin U.S. Pat. No. 4,817,927 discloses in FIG. 4 a winding cone 60 and, in FIG. 3, an anchor cone 10. A tool (not shown) is inserted into apertures 68 or 69 for selectively adjusting the tension in the torsion spring 50 and set screws are provided through aperture 64 in base 62 for mounting the winding cone to the torsion rod 34. Martin provides markings on the winding cones to indicate which direction each cone should be rotated to wind the torsion spring 50. Similarly, Kalister U.S. Pat. No. 3,779,537 discloses a winding cone and winding base that includes both left-hand and right-hand threads for receiving either a left-hand or right-hand wound spring. Similar to Martin, the winding cone is secured to the torsion rod by set screws. The winding cones of both of these references fail to provide a failsafe for insuring that the torque of the torsion spring is adequately braced against when the winding cone is released from the torsion rod for winding of the torsion spring.

Apart from the structure of a torsion spring assembly or a winding cone, Way U.S. Pat. No. 5,605,079 actually relates to a device for rotating the winding cone and winding the torsion spring for increasing winding tension. In particular, Way discloses a housing that is mountable to a winding cone to which ratchet arms are attachable for increasing the tension in the torsion spring. In using the device, a ratchet arm must be braced to counteract the force of the torsion spring that is released when the set screw is removed. In Way no failsafe is provided whereby the spring force must first be overcome before disengagement of the set screw. In fact, the opening 66 by which the set screw is accessible is continuously aligned with the set screw 34 and the housing 36 in which the opening is formed is fixed to the winding cone. Thus, the set screw is continuously accessible in the device of Way.

The prior art also includes devices for adjusting the operating tension range in a torsion spring assembly which does not involve the rotation of the winding cone relative to the torsion rod and, thus, does not include the dismounting of the winding cone from the torsion rod to which the failsafe of the present invention relates. Such devices are disclosed, for example, by Davis U.S. Pat. No. 4,882,806; Carper et al. U.S. Pat. Nos. 5,636,678 and 5,632,063; and Husselton U.S. Pat. No. 5,239,777. None of these mechanisms relate to the winding of the torsion spring by rotation of the winding cone relative to the torsion shaft, nor do they provide a safeguard against an inadequate force bracing against the release of the torsion spring tension.

Looking beyond overhead doors to the art of spring hinges, a few references relate to the adjustment of the tension in torsion springs thereof. In Rapp U.S. Pat. No. 4,817,242, a spring hinge for a toilet seat is disclosed wherein the tension in the torsion spring is adjustable. Specifically, Rapp discloses, with relevance to the present invention, a torsion spring 2 axially disposed about a rod 1 within a hinge. A first end of the torsion spring 2 is secured to end cap 9 and a second end of the torsion spring is secured to a first coupling member 6 that is mounted to the rod 1 and that has teeth which interlock with a second coupling member 5. End cap 9 is mounted to the toilet and second coupling member 5 is mounted to the seat. The first coupling member 6, and the second coupling member 5, when interlocked therewith, are rotational with the rod 1 relative to end cap 9, which rotation increases and decreases the tension in torsion spring 2 within a certain range. This range of tension is adjusted by: first axially moving the first coupling member 6 away from the second coupling member 5 into an unlocked position by axially displacing rod 1 against the spring force via knob 8 thereby compressing the spring; then rotating the first coupling member 6 and the spring 2 attached thereto relative to the second coupling member 5 by rotating rod 1 via knob 8; and then moving the first coupling member 6 back into interlocking relation with the second coupling member 5 by releasing the knob 8.

Curry et al. U.S. Pat. No. 4,073,038 discloses a spring hinge in which the torsion spring 23 biasing the hinge has a selectable tension range. In particular, torsion spring 23 is retained between cone 22 fixed to hinge 12 via set screw 35, and cone 24 coupled to plug 20 which, in turn, is fixed to hinge 11 via set screw 32. The coupling between cone 24 and plug 20 is accomplished through mating engagement surfaces 26,27. When the tension range is to be adjusted, a wrench 29 is inserted through an opening in the plug 20 into an opening 28 in cone 24. Due to the contoured engagement surfaces 26,27, rotation of the wrench about the axis of the torsion spring 23 in a first direction will cause the cone 24 and plug 20 to rotate relative to one another in segmented increments. However, the contoured engagement surfaces 26,27 prevent the rotation of the cone 24 and plug 20 in the segmented steps in the opposite direction unless the cone 24 and plug 20 are separated by an axial force applied directly to the cone 24 via the wrench 29.

Hwang U.S. Pat. No. 5,048,155 discloses a spring hinge in which the torsion spring biasing the hinge has an adjustable tension range. In particular, torsion spring 30 is retained between end cap 50, secured to a first hinge by set screw 90, and end cap 40 secured to a second hinge by set screw 70. A number of openings are formed in the second hinge member 10 and, in particular, in knuckle 12 in which the end cap 40 is disposed, through which set screw 70 can engage and retain end cap 40. A pin 83 and openings for the pin in knuckle 12 are also provided whereby the end cap 40 can be immobilized when set screw 70 is removed. Adjusting the tension range of the torsion spring with wrench is then possible once pin 83 holding the torsion spring against unwinding is removed; however, sufficient torque must be applied to the end cap 40 through wrench in order to overcome the frictional forces acting on the pin 83 due to the spring tension for withdrawal thereof through the opening.

As will be apparent, none of these references disclose or suggest a failsafe whereby the torque of a torsion spring in a torsion spring assembly of a counterbalancing mechanism of an overhead door must be overcome before the winding cone can be unsecured from the torsion rod.

SUMMARY OF THE PRESENT INVENTION

It is therefore an object of the present invention to provide a failsafe whereby the torque of a torsion spring in a torsion spring assembly of a counterbalancing mechanism of an overhead door must be overcome before the winding cone can be unsecured from the torsion rod.

It is also an object of the present invention merely to provide, without regard to the aforementioned failsafe, a new winding cone structure comprising two coupling components disposed in abutment with one another for limited rotational movement. One of the winding cone components receives and retains an end of a torsion spring and the other component anchors the first component to a torsion rod.

Briefly described, the present invention broadly encompasses a winding cone comprising a first mounting component defining an area for receiving therein a fastener for mounting of the first component to a torsion rod for rotation therewith; and a second winding component including a frusto-conical surface for receiving an end of a torsion spring. The second component is disposed adjacent the first component for limited rotational movement about an axis of and relative to the first component between first and second rotational positions.

In a feature of the present invention, the second component includes a covering portion disposed relative to the first component such that the covering portion inhibits access to the area of the fastener when the second component is in the first rotational position. However, the covering portion permits access to the area of the fastener when the second component is in the second rotational position.

In yet another feature of the present invention, the first component includes a blocking portion which engages the second component and prevents rotation of the second component relative to the first component in a first rotational direction when the second component is in the first rotational position.

A counterbalancing mechanism for an overhead door of the present invention includes a first torsion spring assembly having a torsion rod extending along a longitudinal axis of and within a torsion spring; an anchor member retaining a first end of the torsion spring with the torsion rod being rotatable about the axis relative to the anchor member; and a winding cone of the present invention retaining a second end of the torsion spring.

A method of the present invention includes winding a torsion spring retained at one end by an anchor and at another end by a winding component engaged with a mounting component to form a winding cone. The steps of the method include gaining access to a fastener securing the mounting component to a torsion rod by applying torque against the torque of the torsion spring to the winding component which covers the fastener; releasing the fastener to unfasten the mounting component from the torsion rod while applying the torque; winding the torsion spring by applying a greater torque to the winding component against the torque of the torsion spring; fastening the fastener to remount the mounting component to the torsion rod while applying the greater torque; and covering the fastener with the winding component by discontinuing the application of torque to the winding component.

BRIEF DESCRIPTION OF THE DRAWINGS

Further features and advantages of the present invention are set forth below in the detailed description of the preferred embodiments and in the drawings, wherein.

DETAILED DESCRIPTION OF PREFERRED EMBODIMENTS

Figure 1:
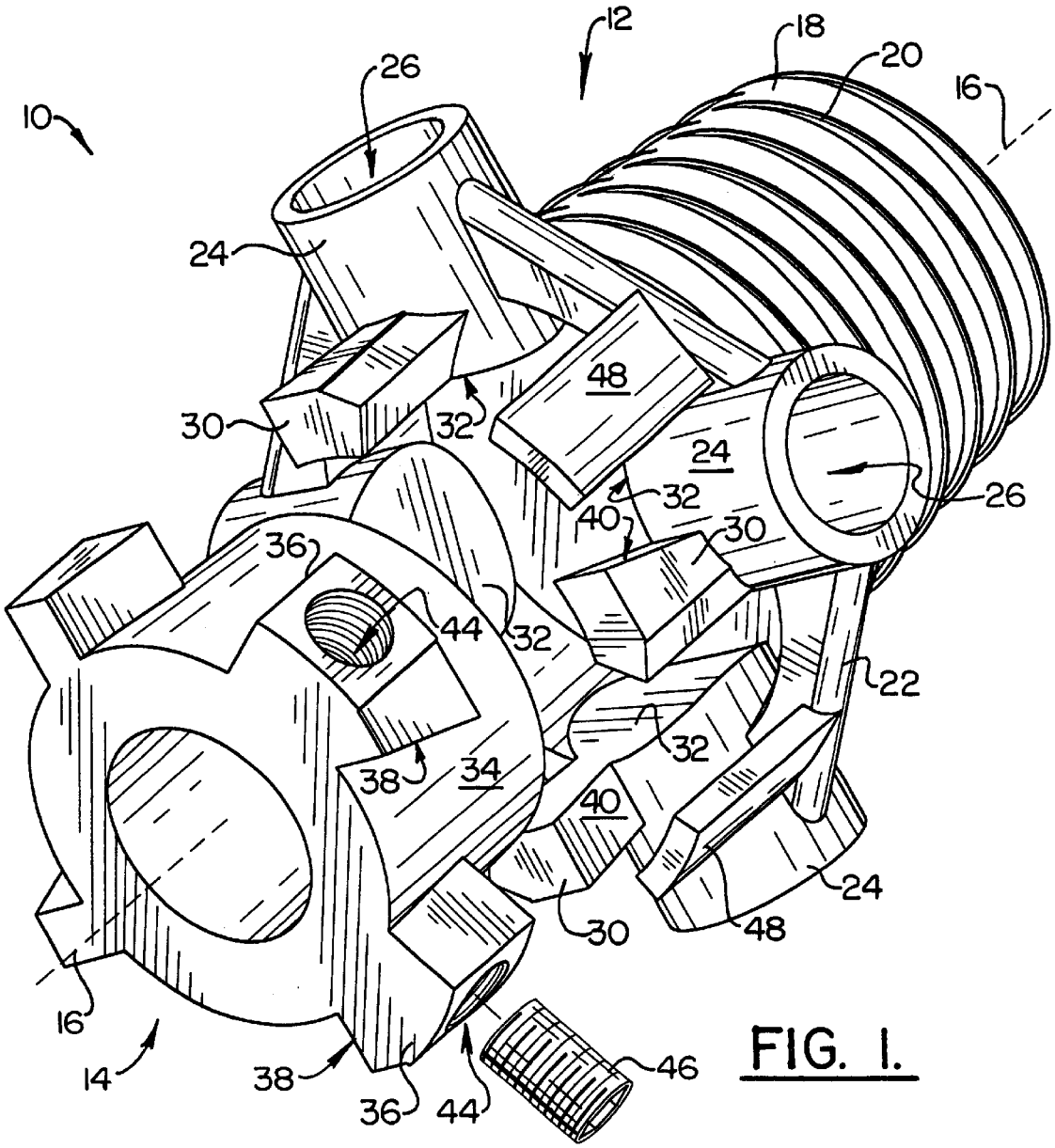
FIG. 1 is a perspective, exploded view of two coupling members of a winding cone of the present invention.
Figure 2:
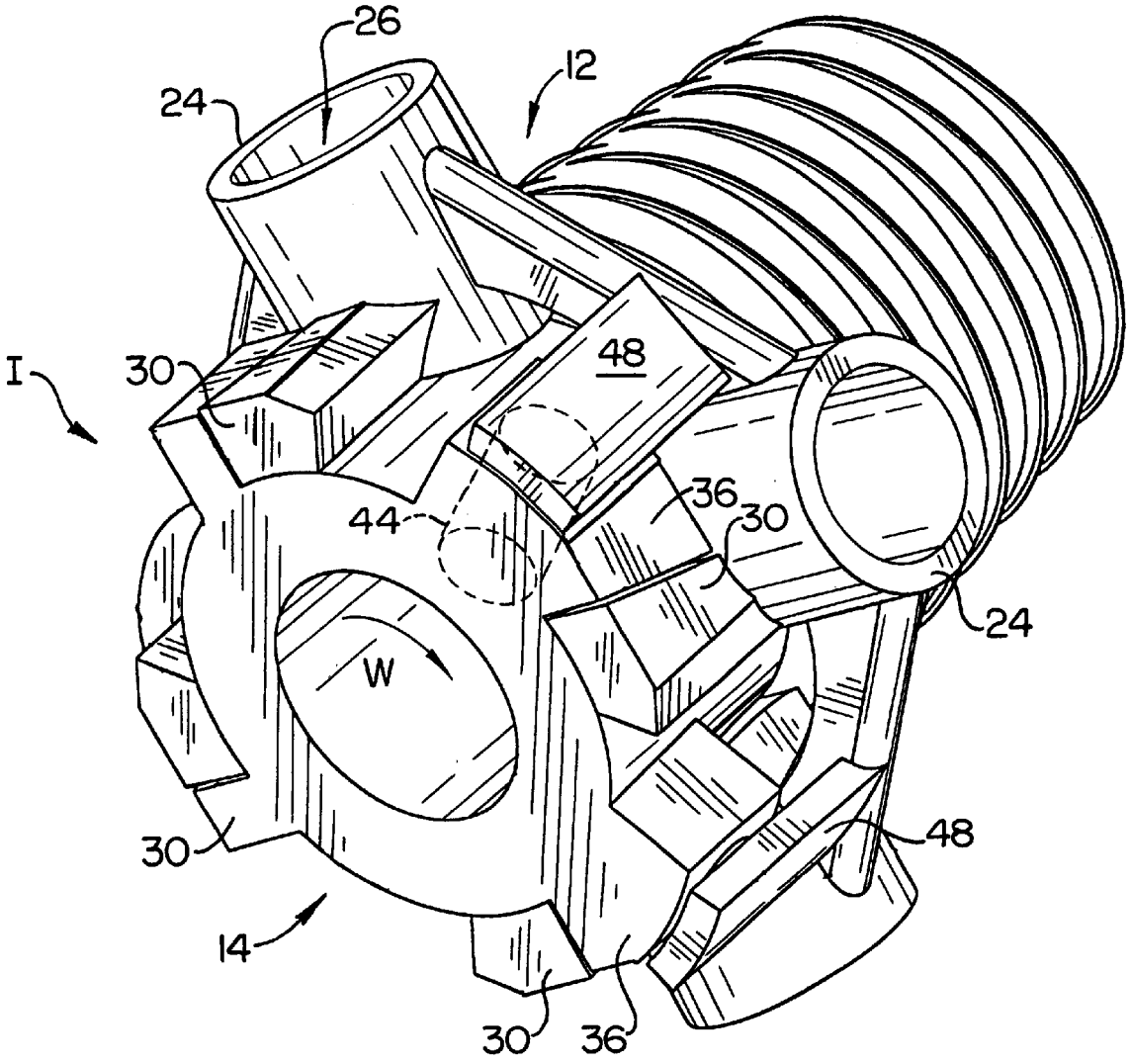
FIG. 2 is a perspective view of the winding cone of FIG. 1 in a first rotational position.
Figure 3:
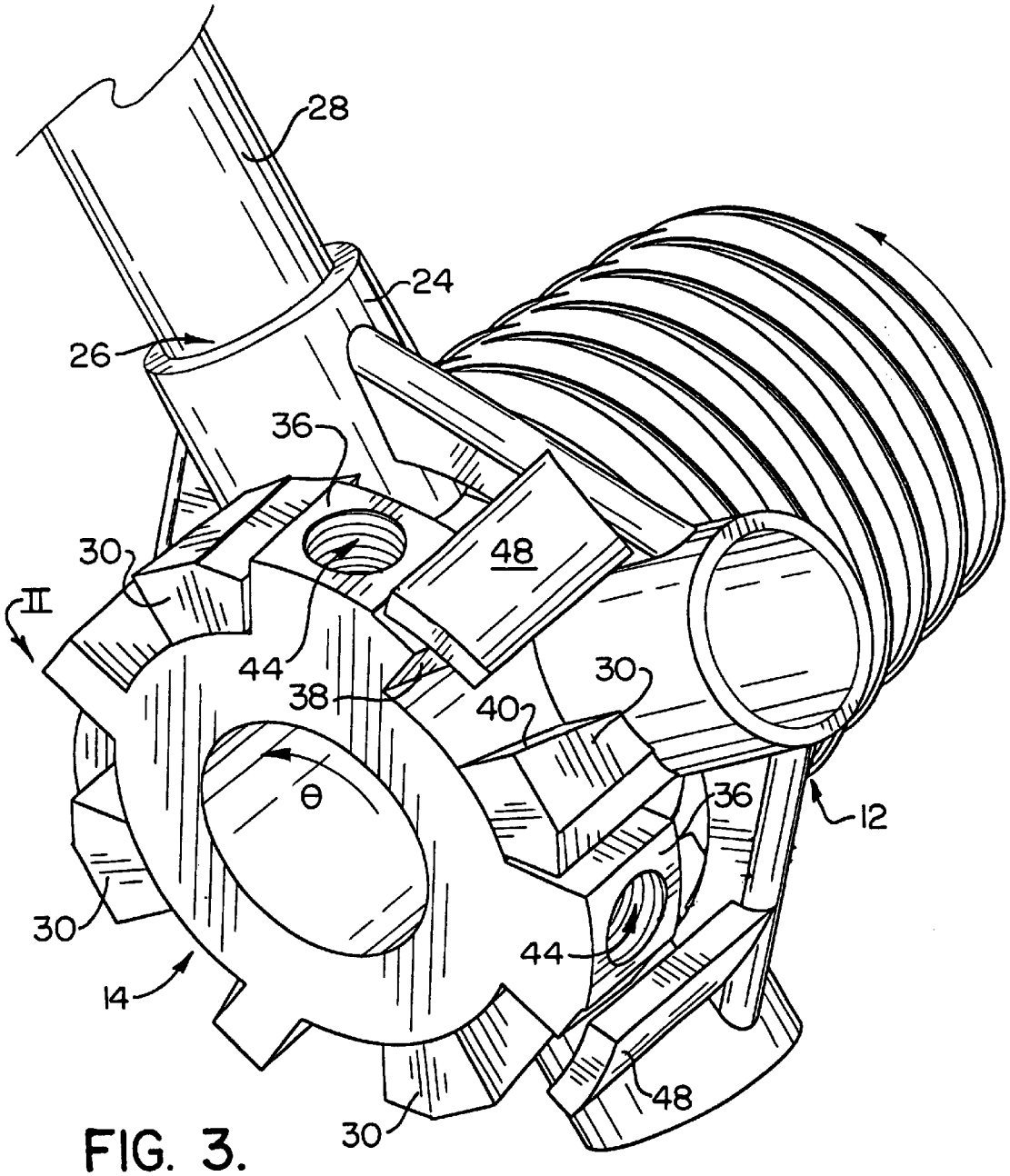
FIG. 3 is a perspective view of the winding cone of FIG. 1 in a second rotational position.
Figure 4:
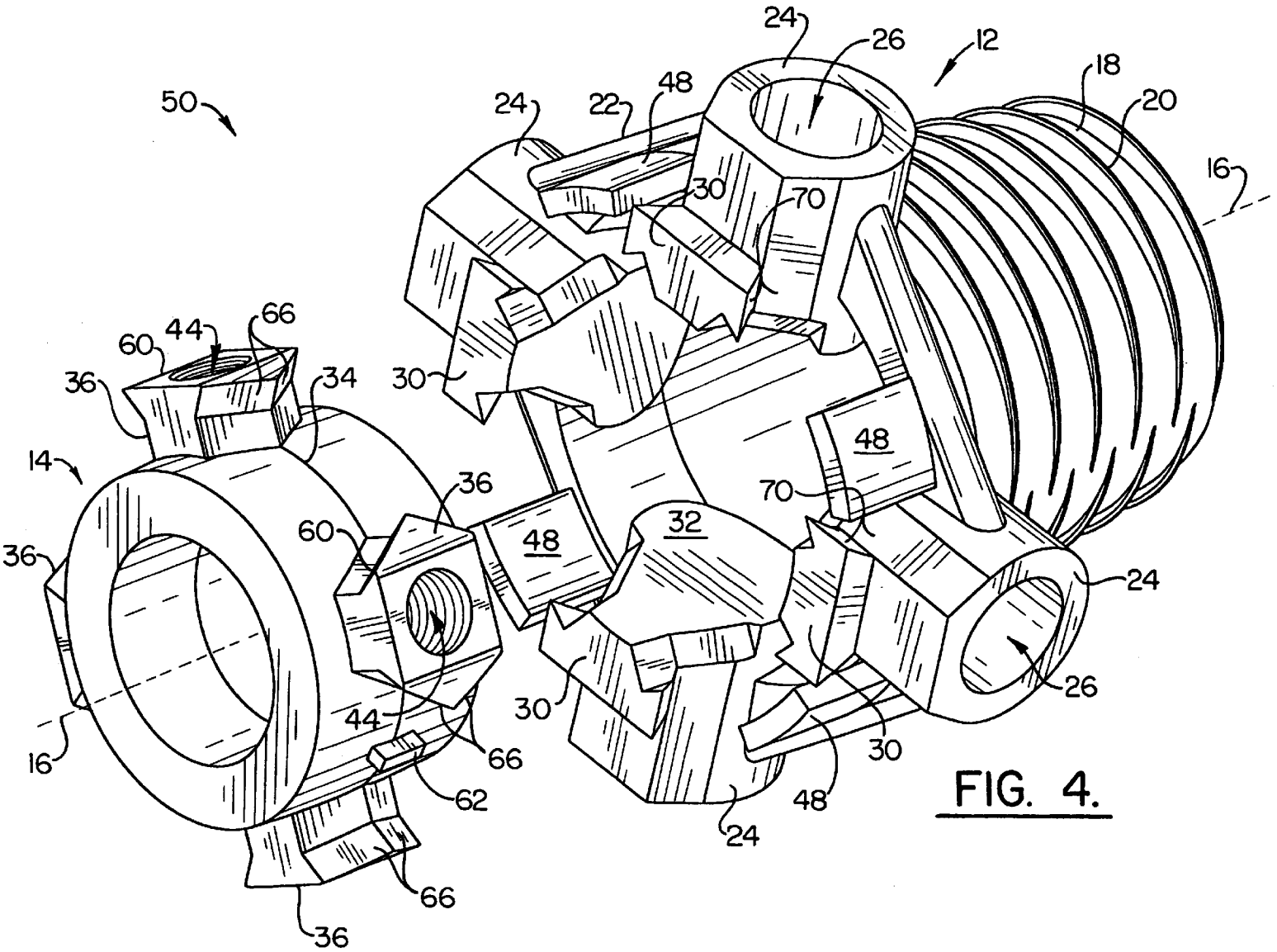
FIG. 4 is a perspective, exploded view of two coupling members of another winding cone of the present invention.
Figure 5:
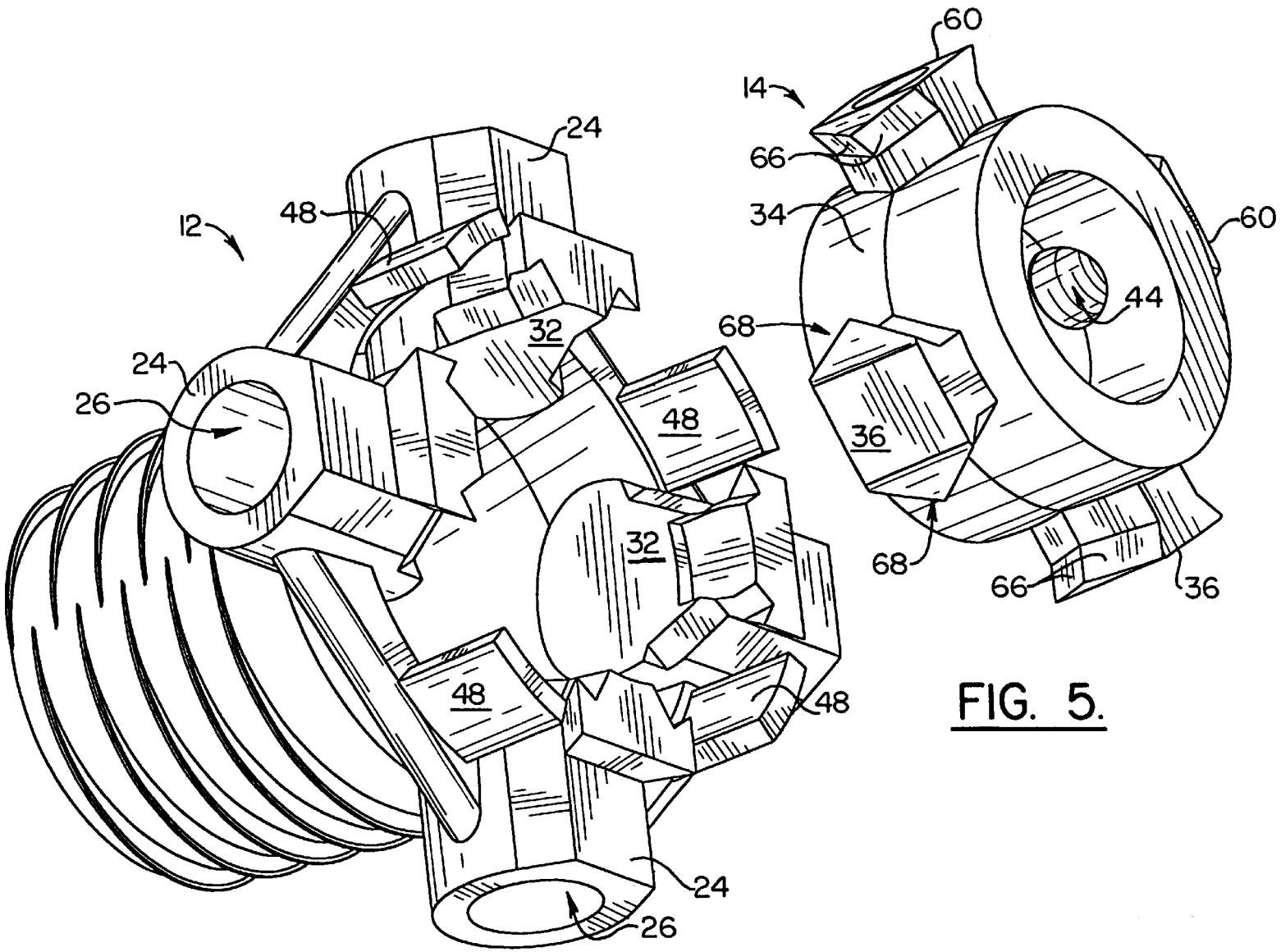
FIG. 5 is a reverse angle perspective, exploded view of the two coupling members of FIG. 4.
Figure 6:
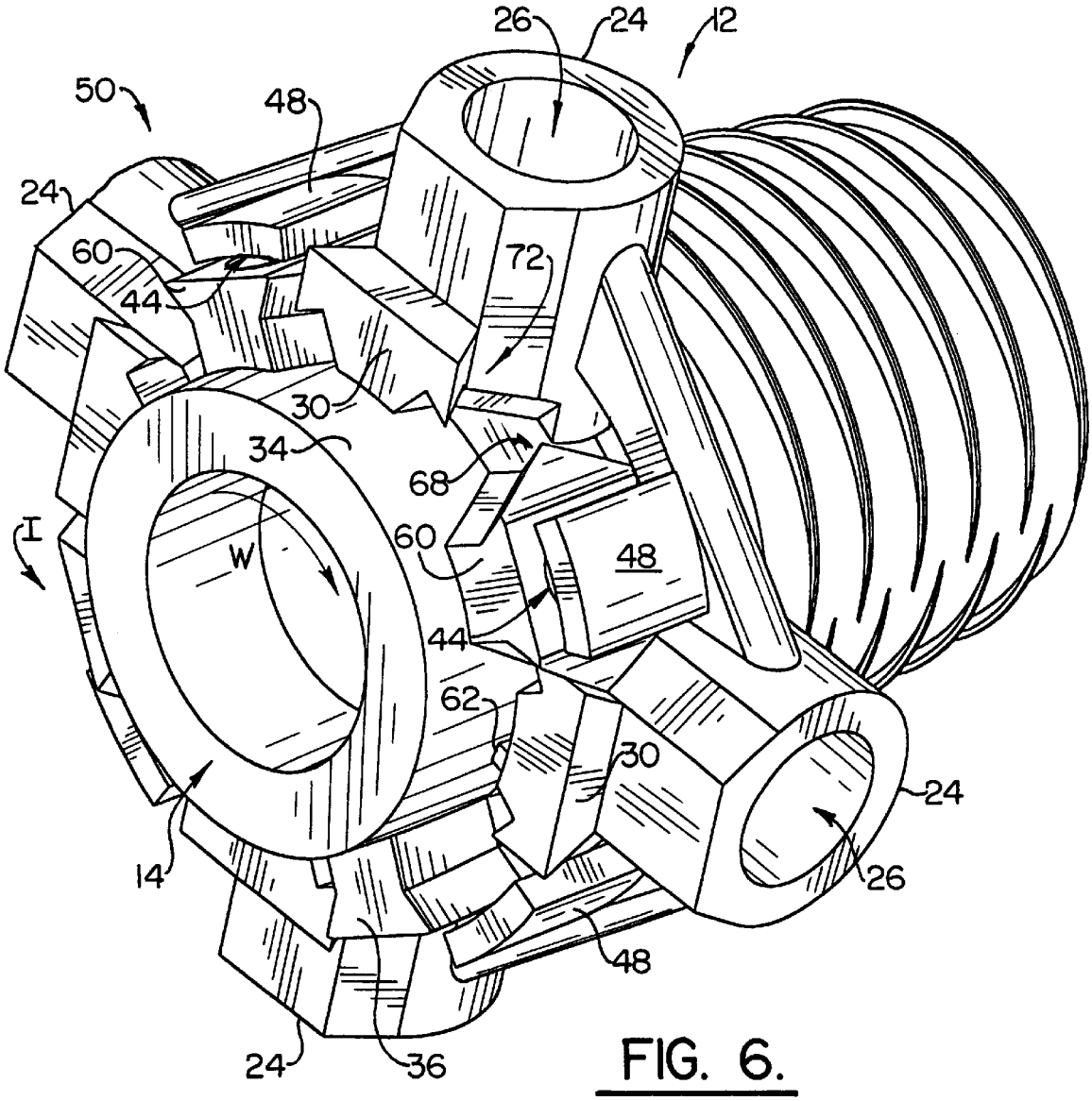
FIG. 6 is a perspective view of the winding cone of FIG. 4 in a first rotational position.
Figure 7:
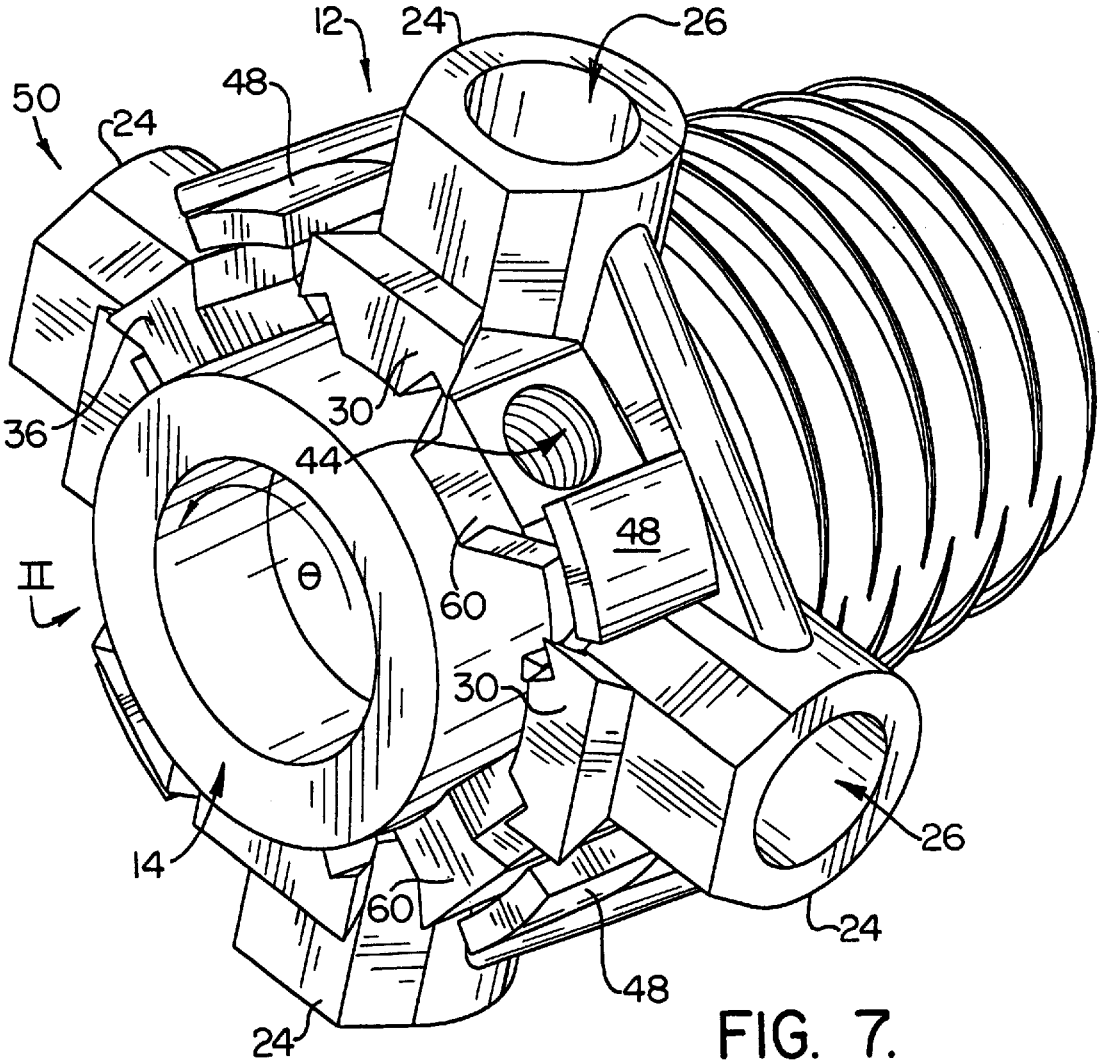
FIG. 7 is a perspective view of the winding cone of FIG. 4 in a second rotational position.

Two preferred embodiments of the winding cone of the present invention are shown in the drawings. As will be explained in detail below, the winding cone of FIGS. 1–3 is a simpler embodiment and is designed for use with a right-hand torsion spring, whereas the winding cone of FIGS. 4–8 can be used with either a right hand torsion spring or a left hand torsion spring. Thus, the components forming the winding cone of FIGS. 4–9 are versatile and molds for manufacturing the components do not depend upon the type of torsion spring with which the components will be utilized. Referring now to the drawings, like structures between the two embodiments of the winding cone of the present invention will be referred to with like reference numbers.

Turning first to the embodiment of FIGS. 1–3, the winding cone 10 is formed by the combination of two components, namely, a first winding cone coupling member 12 and a second winding cone coupling member 14. In FIG.

1, the first and second coupling members 12,14 are shown in exploded view along axis 16. The first coupling member 12 comprises a winding component and includes a frusto conical surface 18 having spiral grooves 20 for receiving and retaining the coils of an end of a conventional torsion spring 21 (shown, for example, in FIG. 9). A polygonal ring 22 is disposed at one end of the frusto conical surface 20 and is coaxial therewith. The ring 22 includes four radial extensions 24 symmetrically disposed about axis 16, with at least one radial extension 24 (but preferably all) defining an opening 26 for receiving therein a winding bar 28 (shown in FIG. 3) for winding of the torsion spring 21 when secured on the frusto conical surface 18. Four guide members 30 extend generally axially from the ring 22 and, in conjunction with the radial extensions 24, define a discontinuous surface 32 of the first coupling member 12 disposed circumferentially about axis 16 for snuggly receiving a cylindrical body 34 of the second coupling member 14 therein, as shown in FIGS. 2–3.

Furthermore, while snuggly received within the first coupling member 12, the first coupling member 12 is nevertheless configured for rotational movement around the second coupling member 14 about axis 16. In order to limit the degree of rotational movement of the first coupling member 12 about the second coupling member 14, the second coupling member 14 includes blocking portions 36 which engage the guide members 30 of the first coupling member 12 when the first coupling member 12 is rotated by an attached torsion spring 21 in a first rotational direction ω into a first rotational position I shown in FIG. 2. Each blocking portion 36 also includes a slanted surface 38 which tends to urge the first coupling member 12 into abutment with the second coupling member 14 when the first coupling member 12 is urged in the first rotational direction ω by the attached torsion spring 21. Each guide member 30 also preferably includes a corresponding slanted surface 40 for urging the first coupling member 12 into abutment with the second coupling member 14 as a result of the torque of the torsion spring 21 when attached.

The second coupling member 14 comprises a mounting component and is adapted to be releasably secured to a torsion rod 42 (shown in FIG. 9) when extending along axis 16 of FIG. 1. To this end, the second coupling member 14 includes fastener receiving areas 44 preferably defined within said blocking portions 36 through which a fastener such a set screw 46 is disposed for mounting of the second coupling member 14 to the torsion rod 42.

When the first coupling member 12 is disposed in the first rotational position I as shown in FIG. 2, the first coupling member 12 includes covering portion 48 each of which extends over a blocking portion 36 of the second coupling member 14 and blocks access to a fastener receiving area 44 and any set screw 46 disposed therein. Release of the set screw 46 is thereby prevented until the first coupling member 12 is rotated in a second rotational direction θ opposite the first rotational direction ω to a second rotational position II as shown in FIG. 3. Movement of the first coupling member 12 is against the torque of the attached torsion spring 21 which urges the first coupling member 12 towards the first rotational position I. In order to facilitate manual rotation of the first coupling member 12 in opposition to the torsion spring 21, each radial extension 24 defines an opening 26 for receiving therein a winding bar 28 as mentioned above and as shown in FIG. 3.

In the winding cone 10 of FIGS. 1–3, only two blocking portions 36 have fastener receiving areas 44 formed therein, as it has been found sufficient in practice only to provide two fasteners 46 for retention of the second coupling member 14 to the torsion rod 42.

The winding cone 50 of FIGS. 4–8 also includes a first coupling member 12 and a second coupling member 14. Again, fastener receiving areas 44 preferably are formed in just two blocking portions 60.

In order that the winding cone 50 may be used with either a right-hand torsion spring or a left-hand torsion spring, four covering portions 48 of the first coupling member 12 are provided circumferentially disposed about axis 16 in an asymmetrical configuration whereby a pair 52 of covering portions 48 cover the pair 54 of fastener receiving areas 44 when the first coupling member 12 is disposed in the first rotational position I, and a pair 58 of covering portions 48 cover the pair 60 of blocking portions 36 lacking the fastener receiving areas 44 when the first coupling member 12 is disposed in the second rotational position II.

Figure 8:
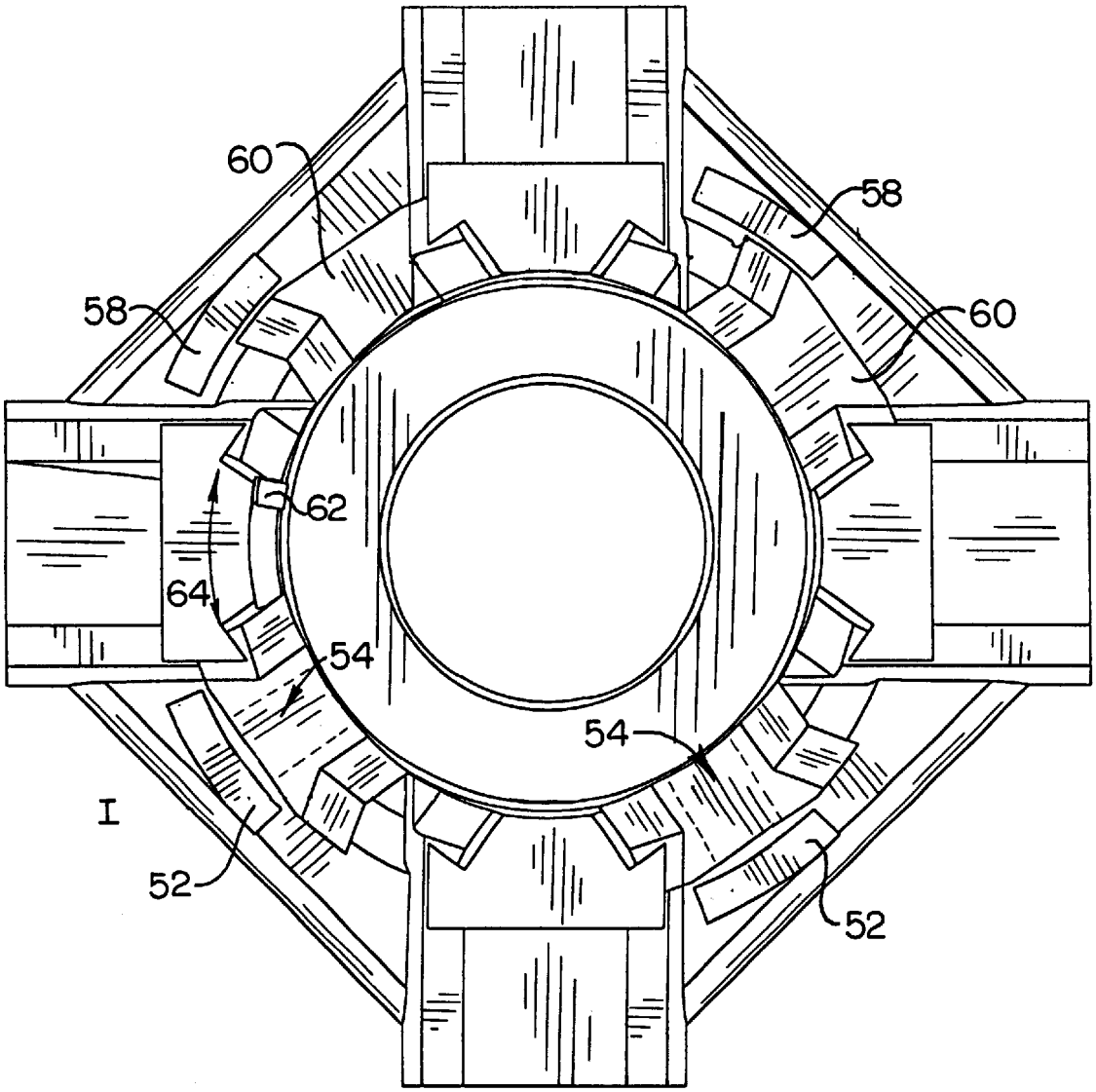
FIG. 8 is an plan view along an axis of the winding cone of FIG. 6.

Furthermore, a projecting tab portion 62 is also provided on the second coupling member 14 which radially extends therefrom for disposition within a limited rotational area 64 defined by the first coupling member 12, whereby the second coupling member 14 will not fit within the first coupling member 12 unless the projecting tab portion 62 is properly aligned with the limited rotational area 64. The blocking portions 36 themselves are symmetrically disposed circumferentially about axis 16. Consequently, the winding cone 50 may be used with a right-hand torsion spring resulting in the disposition of the first coupling member 12 as shown in FIG. 8. In order to use the winding cone 50 with a left-hand torsion spring instead, the second coupling member 14 need only be reversed whereby the torque of the left-hand torsion spring would thereby urge the pair of covering portions 52 into covering relation with the pair 56 of blocking portions 36 including the pair 54 of fastener receiving areas 44. The projecting tab portion 62 thereby insures that the first coupling member 12 and the second coupling member 14 are oriented for proper covering of the pair 56 of blocking portions 36 having the pair 54 of fastener receiving areas 44 formed therein when the second coupling member 14 is reversed.

Alternatively, if fastener receiving areas 44 are provided in each blocking portion 36 (not shown), then the second coupling member 14 need not be reversed in order to use the winding cone 50 shown in FIG. 8 with a left-hand torsion spring. Instead, set screws 46 may be disposed through fastener receiving areas 44 in the pair 60 of blocking portions 36 instead of the pair 56 of blocking portions 36. The winding cone 50 illustrated in FIG. 8 would then be disposed in the second rotational position II with the set screws 46 exposed.

An additional difference between winding cone 50 of FIGS. 4–8 and winding cone 10 of FIGS. 1–3 includes the addition on each blocking portion 36 of the winding cone 50 of slanted engagement surfaces 66 which form a V-shaped projecting portion 68. Further, a V-shaped projecting portion 68 is formed on each rotational side of each blocking portion 36, and each guide member 30 and radial extension 24 of the first coupling member 12 together include slanted engagement surfaces 70 which define a V-shaped recess 72 on each rotational side thereof for receipt of one of the V-shaped projection portions 68 therein. By disposing these engagement surfaces 66,70 on opposite rotational sides of the blocking portions 36 and the guide members 30 and radial extensions 24, the two coupling members 12,14 are not only urged into abutment by the torque of the torsion spring 21 when the first coupling member 12 is in the first rotational position I, but also urged into abutment when the torque of the torsion spring is manually overcome and the first coupling member 12 is rotated into the second rotational position II to thereby provide axial stability to the first coupling member 12 as the set screws 46 are released.

Figure 9:
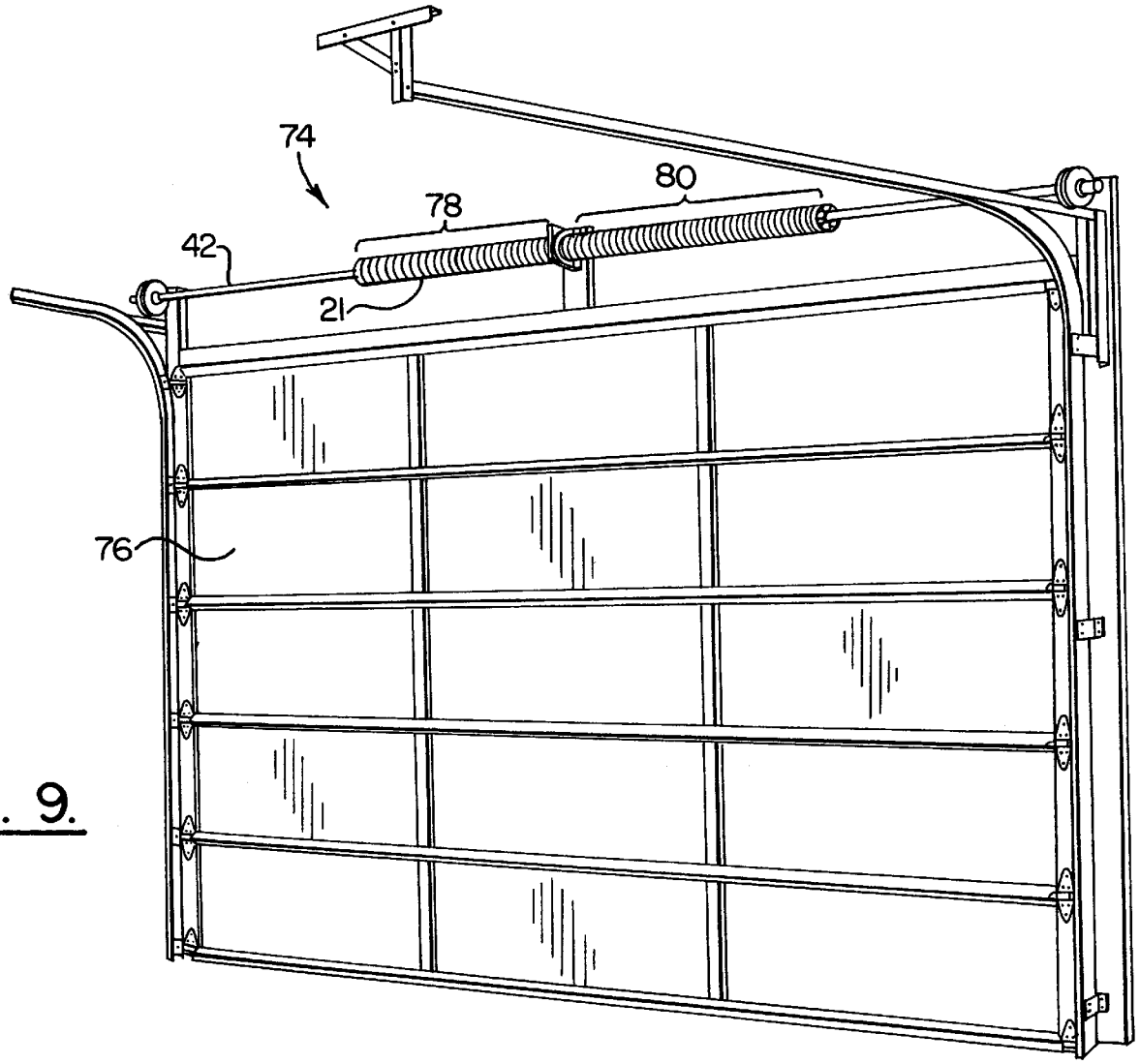
FIG. 9 is a perspective view of the counterbalancing mechanism of the present invention.

A counterbalancing mechanism 74 for an overhead door 76 is shown in FIG. 9. The counterbalancing mechanism 74 utilizes two torsion spring assemblies. Each torsion spring assembly 78,80 includes a winding cone 50 of the present invention and a torsion spring 21 oppositely wound to that of the torsion spring 21 of the other torsion spring assembly 80,78.

If adjustment to the tension in a torsion spring 21 of an assembled torsion spring assembly 78,80 of the present invention is desired, a winding bar 28 for winding of the torsion spring 21 is inserted into an opening 26 of a radial extension 24 of the first coupling member 12. A torque T is then applied opposite the torque S of the torsion spring 21 whereby the first coupling member 12 is rotated out of the first rotational position I to the second rotational position II whereat access is gained to the set screws 46 disposed within the fastener receiving areas 44 initially obstructed by the covering portions 48. Preferably, the blocking portions 36 engage the guide members 30 and radial extensions 24 and provide axial stability to the first coupling member 12 when in the second rotational position II. It will also be noted that by applying a torque T sufficient to rotate the first coupling member 12 to the second rotational position II, the torsion spring 21 is incrementally wound.

At this point the set screws 46 for which access has been gained are unsecured whereby the second coupling member 14 is freed to rotate with respect to the torsion rod 42. Furthermore, during rotation and winding of the torsion spring 21 preferably the first coupling member 12 remains in abutment with the second coupling member 14 for rotation of the winding cone.

If a higher torsion spring tension is desired, the winding bar 28 is then used to continue to wind the torsion spring 21 against the spring torque until the desired tension is obtained. If the torsion spring assembly needs to be disassembled or the tension thereof simply needs to be relieved or lessened, the winding cone is wound in the same manner but in the reverse direction, i.e., in the direction of the spring torque.

It should be noted that clearance between the winding cone and a ceiling or wall often will not permit full rotation of the winding cone. In such case a second winding bar 28 is preferably inserted into another of the openings 26 whereby alternate stepped use of the winding bars 28 permits continued rotation of the winding cone to a desired tension.

When the desired tension is reached, the set screws 46 are again secured to the torsion rod 42. The torque manually applied to the first coupling member 12 is then decreased as the first coupling member 12 is rotated back into the first rotational position I to again block access to the set screws 46. The winding bar 28 then in use is removed once the blocking portions 36 are engaged by the first coupling member 12 in the first rotational position I. Of course, if all tension has been relieved, then the set screws 46 need not be refastened.

The winding cone of the present invention thus provides in a simple, and convenient manner a safety feature not enjoyed by conventional winding cones. In particular, the winding cone of the present invention prevents access to the fasteners until the torque of the torsion spring is overcome, whereby the danger of the torsion spring being greater than expected and suddenly unwinding when the set screws are released is avoided.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

Thus, it will be apparent, for example, that the projection tab portion, while insuring proper orientation of the coupling members as discussed above, itself also may serve as a blocking portion preventing the rotation of the first coupling member in the first rotational direction from the first rotational position.

What is claimed is:

1. A winding cone comprising:

a first mounting component defining an area for receiving therein a fastener for mounting of said first component to a torsion rod for rotation therewith; and a second winding component receiving an end of a torsion spring, said second component being disposed adjacent said first component for limited rotational movement about an axis of and relative to said first component between first and second rotational positions, said second component further including a covering portion disposed relative to said first component such that said covering portion inhibits access to said area of said fastener when said second component is in said first rotational position, and said covering portion permits access to said area of said fastener when said second component is in said second rotational position.

2. A winding cone according to claim 1, wherein said first component includes a blocking portion which engages said second component and prevents rotation of said second component relative to said first component in a first rotational direction when said second component is in said first rotational position.

3. A winding cone, comprising:

a first mounting component defining an area for receiving therein a fastener for mounting of said first component to a torsion rod for rotation therewith; and a second winding component receiving an end of a torsion spring, said second component being disposed adjacent said first component for limited rotational movement about an axis of and relative to said first component between first and second rotational positions, said first component further including a blocking portion which engages said second component and prevents rotation of said second component relative to said first component in a first rotational direction when said second component is in said first rotational position;

wherein said first mounting component and said second mounting component each consists of a monolithic piece.

4. A counterbalancing mechanism for an overhead door, comprising a first torsion spring assembly including, (a) a torsion rod and a torsion spring, said torsion rod extending along a longitudinal axis of and within said torsion spring;

(b) an anchor member retaining a first end of said torsion spring, said torsion rod being rotatable about said axis relative to said anchor member; and (c) a winding cone retaining a second end of said torsion spring, said winding cone including, (i) a first winding cone coupling member including a surface retaining said second end of said torsion spring; and (ii) a second winding cone coupling member and a fastener, said second coupling member defining an area in which said fastener is received and releasably mounts said second coupling member to said torsion rod, said first coupling member being disposed adjacent and abutting said second coupling member for limited rotational movement about said axis relative to said second coupling member between first and second rotational positions, said second coupling member including a blocking portion which engages said first coupling member and prevents rotation of said first coupling member relative to said second coupling member in a first rotational direction when said first coupling member is in said first rotational position, said torsion spring urging said first coupling member in said first rotational direction, wherein said coupling member and said second coupling member each consists of a monolithic piece.

5. A counterbalancing mechanism according to claim 4, wherein said first coupling member includes a covering portion disposed relative to said second coupling member such that said covering portion inhibits access to said fastener when said first coupling member is in said first rotational position, and said covering portion permits access to said fastener when said first coupling member is in said second rotational position.

6. A counterbalancing mechanism according to claim 4, wherein said first coupling member defines an opening for receiving a winding bar for winding of said torsion spring.

7. A counterbalancing mechanism according to claim 4, wherein said first coupling member includes a slanted engagement surface which urges said first coupling member into abutment with said second coupling member when said blocking portion engages said slanted engagement surface.

8. A counterbalancing mechanism according to claim 4, wherein said second coupling member includes slanted engagement surfaces defining a V-shaped recess and said blocking portion defines a corresponding V-shaped projecting portion for receipt within said V-shaped recess.

9. A counterbalancing mechanism according to claim 4, wherein said blocking portion includes a slanted engagement surface which urges said first coupling member into abutment with said second coupling member when said blocking portion engages said first coupling member.

10. A counterbalancing mechanism according to claim 9, wherein the urging of the torsion spring must be overcome in order to axially move said first coupling member out of abutment with said second coupling member.

11. A counterbalancing mechanism according to claim 4, wherein said fastener receiving area is defined within said blocking portion.

12. A counterbalancing mechanism according to claim 11, wherein said second coupling member includes an additional three blocking portions one of which defines an additional area for receiving a fastener for releasable mounting of the second coupling member to said torsion rod.

13. A counterbalancing mechanism according to claim 12, wherein said first coupling member includes four covering portions disposed relative to said second coupling member such that access to each said fastener is inhibited by a said covering portion when said first coupling member is in said first rotational position, and access is permitted when said first coupling member is in said second rotational position.

14. A counterbalancing mechanism according to claim 13, wherein a first pair of said four covering portions covers a pair of said four blocking portions, said pair of blocking portions defining said fastener receiving areas, when said first coupling member is in said first rotational position, and a second pair of said four covering portions covers the other pair of said blocking portions when said first coupling member is in said second rotational position.

15. A counterbalancing mechanism according to claim 14, wherein said second coupling member includes a projecting tab portion that is received within a limited rotational area defined by said first coupling member only when said first coupling member is properly oriented with respect to said second coupling member.

16. A counterbalancing mechanism according to claim 14, wherein said first pair of said covering portions are asymmetrically disposed relative to said second pair of said covering portions.

17. A counterbalancing mechanism according to claim 16, wherein said first coupling member is reversible for accommodating another torsion spring oppositely wound to said torsion spring.

18. A counterbalancing mechanism according to claim 16, further including a second torsion spring assembly disposed in mirror relation to said first torsion spring assembly, wherein said second torsion spring of said second torsion spring assembly is oppositely wound to said first torsion spring of said first torsion spring assembly, but wherein said first and second coupling members of said second torsion spring assembly are identical to said first and second coupling members of said first torsion spring assembly.

19. A method of adjusting tension in a torsion spring retained at one end by an anchor and at another end by a winding component engaged with a mounting component to form a winding cone, comprising:

gaining access to a fastener securing the mounting component to a torsion rod by applying torque against the torque of the torsion spring to the winding component which covers the fastener;

releasing the fastener to unsecure the mounting component from the torsion rod while applying said torque; and by rotating the mounting component relative to the torsion rod thereby adjusting the tension of the torsion spring.

20. The method of claim 19, further comprising the steps of:

increasing the tension in the torsion spring by applying a greater torque to the winding component against the torque of the torsion spring;

resecuring the fastener to remount the mounting component to the torsion rod while applying said greater torque; and covering the fastener with the winding component by discontinuing said application of torque to the winding component.

21. The method of claim 19, further comprising the steps of:

decreasing the tension in the torsion spring by applying a lesser torque to the winding component against the torque of the torsion spring;

resecuring the fastener to remount the mounting component to the torsion rod while applying said lesser torque; and covering the fastener with the winding component by discontinuing said application of torque to the winding component.

22. A winding cone, comprising:

a first mounting component defining an area for receiving therein a fastener for mounting of said first component to a torsion rod for rotation therewith; and a second winding component receiving an end of a torsion spring, said second component being disposed adjacent said first component for limited rotational movement about an axis of and relative to said first component between first and second rotational positions, said first component further including a blocking portion which engages said second component and prevents rotation of said second component relative to said first component in a first rotational direction when said second component is in said first rotational position;

wherein said first component further includes a body defining an opening for receipt therethrough of the torsion rod and wherein said blocking portion is immovable relative to said body defining said opening.

23. A winding cone, comprising:

a first mounting component defining an area for receiving therein a fastener for mounting of said first component to a torsion rod for rotation therewith; and a second winding component receiving an end of a torsion spring, said second component being disposed adjacent said first component for limited rotational movement about an axis of and relative to said first component between first and second rotational positions, said first component further including a blocking portion which engages said second component and prevents rotation of said second component relative to said first component in a first rotational direction when said second component is in said first rotational position;

wherein said first component induces for blocking portions symmetrically disposed about the axis of said first component, each blocking portion engaging said second component and preventing rotation of said second component relative to said first component in a first rotational direction when said second component is in said first rotational position.

24. A counterbalancing mechanism for an overhead door, comprising a first torsion spring assembly including, (a) a torsion rod and a torsion spring, said torsion rod extending along a longitudinal axis of and within said torsion spring;

(b) an anchor member retaining a first end of said torsion spring, said torsion rod being rotatable about said axis relative to said anchor member; and (c) a winding cone retaining a second end of said torsion spring, said winding cone including, (i) a first winding cone coupling member including a surface retaining said second end of said torsion spring; and (ii) a second winding cone coupling member and a fastener, said second coupling member defining an area in which said fastener is received and releasably mounts said second coupling member to said torsion rod, said first coupling member being disposed adjacent and abutting said second coupling member for limited rotational movement about said axis relative to said second coupling member between first and second rotational positions, said second coupling member including a blocking portion which engages said first coupling member and prevents rotation of said first coupling member relative to said second coupling member in a first rotational direction when said first coupling member is in said first rotational position, said torsion spring urging said first coupling member in said first rotational direction, wherein said second coupling member further includes a body defining an opening for receipt therethrough of the torsion rod and wherein said blocking portion is immovable relative to said body defining said opening.

25. A counterbalancing mechanism for an overhead door, comprising a first torsion spring assembly including, (a) a torsion rod and a torsion spring, said torsion rod extending along a longitudinal axis of and within said torsion spring;

(b) an anchor member retaining a first end of said torsion spring, said torsion rod being rotatable about said axis relative to said anchor member; and (c) a winding cone retaining a second end of said torsion spring, said winding cone including, (i) a first winding cone coupling member including a surface retaining said second end of said torsion spring; and (ii) a second winding cone coupling member and a fastener, said second coupling member defining an area in which said fastener is received and releasably mounts said second coupling member to said torsion rod, said first coupling member being disposed adjacent and abutting said second coupling member for limited rotational movement about said axis relative to said second coupling member between first and second rotational positions, said second coupling member including a blocking portion which engages said first coupling member and prevents rotation of said first coupling member relative to said second coupling member in a first rotational direction when said first coupling member is in said first rotational position, said torsion spring urging said first coupling member in said first rotational direction, wherein said second coupling member includes four blocking portions symmetrically disposed about the axis of said second coupling member, each blocking portion engaging said first coupling member and preventing rotation of said first coupling member relative to said second coupling member in a first rotational direction when said second coupling member is in said first rotational position.

26. A counterbalancing mechanism for an overhead door, comprising a first torsion spring assembly including, (a) a torsion rod and a torsion spring, said torsion rod extending along a longitudinal axis of and within said torsion spring;

(b) an anchor member retaining a first end of said torsion spring, said torsion rod being rotatable about said axis relative to said anchor member; and (c) a winding cone retaining a second end of said torsion spring, said winding cone including, (i) a first winding cone coupling member including a surface retaining said second end of said torsion spring; and (ii) a second winding cone coupling member and a fastener, said second coupling member defining an area in which said fastener is received and releasably mounts said second coupling member to said torsion rod, said first coupling member being disposed adjacent and abutting said second coupling member for limited rotational movement about said axis relative to said second coupling member between first and second rotational positions, said second coupling member including a blocking portion which engages said first coupling member and prevents rotation of said first coupling member relative to said second coupling member in a first rotational direction when said first coupling member is in said first rotational position, said torsion spring urging said first coupling member in said first rotational direction, wherein said first coupling member includes a slanted engagement surface which urges said first coupling member into abutment with said second coupling member when said blocking portion engages said slanted engagement surface.

27. A counterbalancing mechanism for an overhead door, comprising a first torsion spring assembly including, (a) a torsion rod and a torsion spring, said torsion rod extending along a longitudinal axis of and within said torsion spring;

(b) an anchor member retaining a first end of said torsion spring, said torsion rod being rotatable about said axis relative to said anchor member; and (c) a winding cone retaining a second end of said torsion spring, said winding cone including, (i) a first winding cone coupling member including a surface retaining said second end of said torsion spring; and (ii) a second winding cone coupling member and a fastener, said second coupling member defining an area in which said fastener is received and releasably mounts said second coupling member to said torsion rod, said first coupling member being disposed adjacent and abutting said second coupling member for limited rotational movement about said axis relative to said second coupling member between first and second rotational positions, said second coupling member including a blocking portion which engages said first coupling member and prevents rotation of said first coupling member relative to said second coupling member in a first rotational direction when said first coupling member is in said first rotational position, said torsion spring urging said first coupling member in said first rotational direction, wherein said second coupling member includes slanted engagement surfaces defining a V-shaped recess and said blocking portion defines a corresponding V-shaped projecting portion for receipt within said V-shaped recess.

28. A counterbalancing mechanism for an overhead door, comprising a first torsion spring assembly including, (a) a torsion rod and a torsion spring, said torsion rod extending along a longitudinal axis of and within said torsion spring;

(b) an anchor member retaining a first end of said torsion spring, said torsion rod being rotatable about said axis relative to said anchor member; and (c) a winding cone retaining a second end of said torsion spring, said winding cone including, (i) a first winding cone coupling member including a surface retaining said second end of said torsion spring; and (ii) a second winding cone coupling member and a fastener, said second coupling member defining an area in which said fastener is received and releasably mounts said second coupling member to said torsion rod, said first coupling member being disposed adjacent and abutting said second coupling member for limited rotational movement about said axis relative to said second coupling member between first and second rotational positions, said second coupling member including a blocking portion which engages said first coupling member and prevents rotation of said first coupling member relative to said second coupling member in a first rotational direction when said first coupling member is in said first rotational position, said torsion spring urging said first coupling member in said first rotational direction, wherein said blocking portion includes a slanted engagement surface which urges said first coupling member into abutment with said second coupling member when said blocking portion engages said first coupling member.

29. A counterbalancing mechanism according to claim 28, wherein the urging of the torsion spring must be overcome in order to axially move said first coupling member out of abutment with said second coupling member.

30. A counterbalancing mechanism for an overhead door, comprising a first torsion spring assembly including, (a) a torsion rod and a torsion spring, said torsion rod extending along a longitudinal axis of and within said torsion spring;

(b) an anchor member retaining a first end of said torsion spring, said torsion rod being rotatable about said axis relative to said anchor member; and (c) a winding cone retaining a second end of said torsion spring, said winding cone including, (i) a first winding cone coupling member including a surface retaining said second end of said torsion spring; and (ii) a second winding cone coupling member and a fastener, said second coupling member defining an area in which said fastener is received and releasably mounts said second coupling member to said torsion rod, said first coupling member being disposed adjacent and abutting said second coupling member for limited rotational movement about said axis relative to said second coupling member between first and second rotational positions, said second coupling member including a blocking portion which engages said first coupling member and prevents rotation of said first coupling member relative to said second coupling member in a first rotational direction when said first coupling member is in said first rotational position, said torsion spring urging said first coupling member in said first rotational direction, wherein said first coupling member includes a covering portion disposed relative to said second coupling member such that said covering portion inhibits access to said fastener when said first coupling member is in said first rotational position, and said covering portion permits access to said fastener when said first coupling member is in said second rotational position.

* * * * *